US006739412B2

(12) United States Patent
Shotton

(10) Patent No.: US 6,739,412 B2
(45) Date of Patent: May 25, 2004

(54) PILE BORING TOOLS

(75) Inventor: Peter Gilbert Shotton, Flackwell Heath (GB)

(73) Assignee: Cementation Foundations Skanska Limited, Hertfordshire (GB)

( * ) Notice: Subject to any disclaimer, the term of this patent is extended or adjusted under 35 U.S.C. 154(b) by 79 days.

(21) Appl. No.: 10/233,681

(22) Filed: Sep. 4, 2002

(65) Prior Publication Data

US 2004/0040728 A1 Mar. 4, 2004

(51) Int. Cl.[7] ..... E21B 10/00

(52) U.S. Cl. ..... 175/57; 175/238; 175/317; 175/396; 175/308

(58) Field of Search ..... 175/308, 309, 175/310, 311, 238, 317, 396, 20, 57

(56) References Cited

U.S. PATENT DOCUMENTS

| | | | | | |
|---|---|---|---|---|---|
| 94,669 | A | * | 9/1869 | Tisdale | 175/242 |
| 243,641 | A | * | 6/1881 | Smith | 175/384 |
| 903,194 | A | * | 11/1908 | Johanson | 175/241 |
| 1,916,691 | A | * | 7/1933 | Schroeder | 175/273 |
| 2,245,750 | A | * | 6/1941 | Betts | 175/57 |
| 2,352,326 | A | * | 6/1944 | Kandle | 175/242 |
| 2,810,553 | A | * | 10/1957 | William | 175/310 |
| 2,873,950 | A | * | 2/1959 | Kandle | 175/90 |
| 3,185,226 | A | * | 5/1965 | James | 175/102 |
| 4,228,862 | A | * | 10/1980 | Causse | 175/242 |
| 6,612,377 | B2 | * | 9/2003 | Rynard | 172/25 |

FOREIGN PATENT DOCUMENTS

| | | |
|---|---|---|
| EP | 0607470 A1 | 7/1994 |
| EP | 0777032 A1 | 6/1997 |
| GB | 1013529 | 12/1965 |
| GB | 2036135 A | 6/1980 |

* cited by examiner

*Primary Examiner*—Hoang Dang
(74) *Attorney, Agent, or Firm*—Browdy and Neimark

(57) ABSTRACT

A boring apparatus is described which comprises a substantially hollow vessel with a fixed base and a rotatable base. The rotatable base is provided, at its circumference, with at least one side cutter which rotatable with the rotatable base from a first position, in which the at least one side cutter serves to cover a respective opening provided in the vessel wall, to a second position, in which the opening in the vessel wall is exposed.

9 Claims, 4 Drawing Sheets

PILE BORING TOOLS

The present invention relates to improvements in rotary pile boring tools. In particular, the present invention relates to a boring 'buckets' for collecting spoil generated during rotary piling operations.

Boring buckets are commonly used by the piling industry when rotary piles are bored under a support fluid, for example bentonite, polymer and even water. Buckets are most commonly used when the strata is non-cohesive, or inter-bedded with cohesive layers.

Typically a boring bucket consists of a cylindrical vessel with a base. It is usually connected to the rotary drive unit by means of a kelly bar. The base of the bucket may be flat or shaped like an inverted cone.

The base has openings (generally two or more) and may be fitted with some sort of soil cutting means, such as "teeth" or "picks", which project below the base of the bucket. During the piling operation, the tool is rotated, thereby causing the teeth to cut into the underlying soil. The soil which is generated then enters the bucket through a number of holes or openings in the base. Generally the base is hingeably mounted to the bottom of the vessel and there may also be provided a mechanism which locks the base to form a secure closure at the bottom of the vessel during boring.

After the boring bucket has been withdrawn from the bore, the mechanism can be actuated to allow the base to swing open, thereby discharging the spoil that was excavated.

One type of bucket in common use is often fitted with steel or rubber flaps which are positioned above the openings in the base. These flaps are intended to allow the passage of soil into the bucket and also serve to retain the soil during the withdrawal of the bucket from the bore.

The diameter of the barrel of the bucket is often smaller than the design diameter of the required pile. In order to address this, it is known for these types of bucket to be fitted with "side-cutters" or teeth which are positioned at the lower end of the barrel. These teeth are oriented with the cutting blades essentially vertical. As the tool is rotated the surrounding soil is cut away from the side of the bore. To allow the soil excavated by the side cutters to enter the bucket, openings positioned just ahead of the side cutters are provided in the barrel. The side cutters are usually fixed such that the overall dimension across the cutters is equal to the design diameter of the pile.

However, it has been found that this bucket design suffers from the disadvantage that a considerable amount of soil can actually be lost through the openings positioned ahead of the side cutters. This not only reduces productivity, but also contaminates the support fluid.

Another type of boring bucket which is known in the art is a "swivel-base", "rotatable-base" or "guillotine" bucket. This type of bucket also has a fixed base, often in the form of a hinged baseplate similar to that described above. Often the barrel of these types of buckets is a truncated cone.

In addition, a second baseplate comprising a rotatable-base, is fixed to the underside of the fixed baseplate, by means of a short co-axial shaft. This arrangement allows the rotatable base to rotate axially with respect to the fixed baseplate.

During the digging process, the tool and bucket are rotated in a first direction which will be referred to from now on as the "digging direction". When the bucket is rotated in the digging direction, the swivel base reacts against the bore, and pivots about a co-axial shaft. This action allows openings in the swivel base to be aligned with openings on the fixed base above, so that the soil generated during digging can pass into the bucket. Once the bucket is full, it can be rotated in the opposite direction, thereby dis-aligning the openings to contain the collected soil within the vessel.

In order to excavate the bore hole, teeth or picks are provided on the underside of the swivel base so that when the tool is rotated, the blades provided on the teeth cut into the soil below. The outer-most teeth (which have their cutting blades oriented essentially horizontally) tend to cut a scrolled groove in the wall of the pile bore. The blades of the teeth are essentially horizontal and the teeth which are closest to the bore surface are usually disposed at an incline and positioned such that the dimension between opposing teeth is equal to the design diameter of the resultant pile.

However, it has been experienced by operators using swivel base buckets that, due to the absence of side cutters and side openings, the full width of the required pile diameter is not reliably excavated by the blades provided below the base. Clearly, in such cases where the diameter of the resultant pile shaft is incorrect, a number of problems will occur. For example, if the diameter of the pile shaft is too small, there can be a risk of reduced shaft adhesion between the pile and the surrounding soil. Furthermore, this may also result in inadequate cover to the reinforcing steel.

To address this problem it has been known to fit one or more reamer blades at the head of the bucket, to ream the bore to the appropriate diameter. However, the use of such a reamer suffers from a number of drawbacks. For example, due to the positioning of the reamer at the head of the bucket, the part of the bore which is below the reamer is not of the correct diameter. Furthermore, the reamer blades have been found to catch on the head of the temporary casing, thereby slowing production. In addition, soil reamed during the boring process commonly falls into the annular gap around the barrel of the bucket. As a consequence, the drilling fluid may become very contaminated.

Accordingly, the present invention seeks to provide a boring apparatus of the type comprising a hollow vessel with a rotatable base, which will excavate the bore to the required design diameter, and which will retain soil excavated from the side of the bore within the hollow vessel.

According to the present invention, there is provided a boring apparatus comprising a substantially hollow vessel having a fixed base and a rotatable base, characterised in that the rotatable base is provided, at its circumference, with at least one side cutter, the side cutter being rotatable with the rotatable base from a first position, in which the at least one side cutter serves to cover a respective opening provided in the vessel wall, to a second position, in which the opening in the vessel wall is exposed.

In contrast to known boring buckets of the fixed base type, in which the side cutters are rigidly fixed to the vessel of the bucket relative to openings provided in the vessel wall, in the present invention the side cutters will rotate relative to the vessel wall during the drilling operation. An advantage of the present invention is therefore not only that the side cutters serve to excavate the side of the bore, but also that the openings are disposed in the vessel wall such that the side cutters effectively cover the openings when the digging action has ceased, thereby preventing excavated ground material from falling out of the vessel.

Preferably the at least one side cutter is in the form of a support arm (or up-stand) provided with a blade, the side cutter serving to cut soil from the edge of the bore hole to allow the outer diameter of the bore to be accurately achieved. The side cutter is preferably arcuate in form, the support arm extending around a part of the circumference of the cylindrical vessel.

Preferably two side cutters are provided which are located on opposite sides of the vessel. The overall dimension between opposing side-cutting teeth (or upstands) is equal to the design diameter of the pile.

Preferably, the fixed baseplate and the rotatable base plate are both provided with openings therein, which are configured so that when the rotatable base member reacts against the bore during a digging operation, the openings in the two base members come into alignment thereby allowing soil to enter into the vessel. Once the vessel is full, the rotational motion ceases, and the base member rotates once more with respect to the vessel body thereby dis-aligning the openings.

The vessel body may be cylindrical or tapered as shown in the accompanying drawings. The lower end of the vessel may be of uniform diameter or may be tapered.

For a better understanding of the present invention and to show how the same may be carried into effect, reference will now be made, by way of example, to the accompanying drawings in which.

It should be appreciated that the dimensions given herein are by way of example only.

Figure 1A:
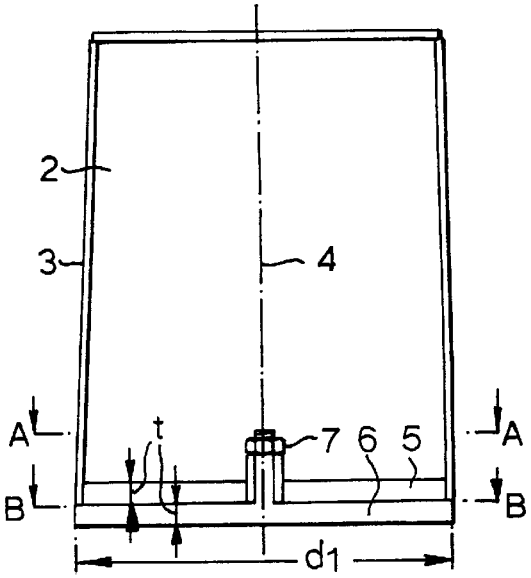
FIGS. 1A and 1B show a cross sectional view through the length of a boring bucket embodying the present invention.

The boring bucket shown in FIG. 1 comprises a cylindrical vessel 2, defined by an outer surface 3 having a length 1 of 1425 mm and having a central longitudinal axis 4. The vessel is hollow and is tapered in shape such that the lower end of the vessel has a diameter d1 of 1100 mm and the top has a diameter d2 of 1020 mm.

The bucket also comprises a first base member 5 in the form of a disk which is fixed to the inner side surface of the vessel. A rotatable base member 6 is also provided below the first base member which is rotatable about a co-axial shaft 7 at the central longitudinal axis of the vessel. The thickness t of both the first base member and the rotatable member is 60 mm.

Figure 1B:
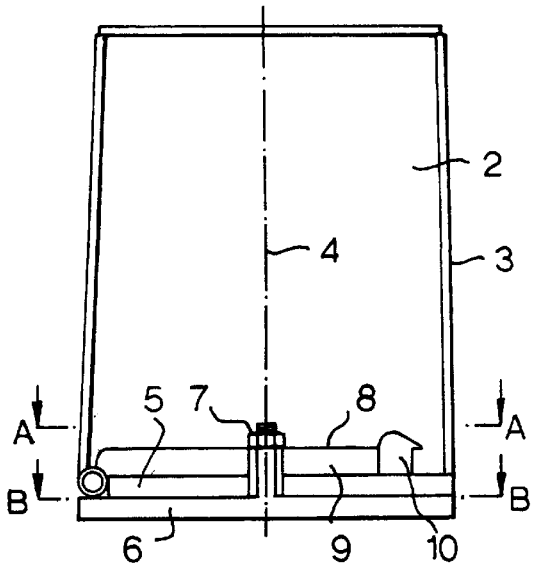

A side cutter 8 is also shown in FIG. 1B. In this embodiment the side cutter 8 comprises an arcuate support arm 9 terminating in a blade 10 and extends around the outer circumference of the vessel 2. The side cutter is attached to the rotatable base member and will therefore be rotatable together with it, with respect to the first base member.

Figure 2A:
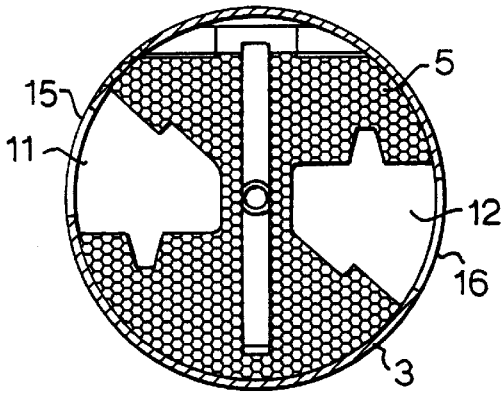
FIG. 2A shows a cross section through the line AA shown in FIG. 1.

FIGS. 2A, B and C show cross sectional views taken through the bucket illustrated in FIG. 1. FIG. 2A shows a section through the line A—A and illustrates a top plan view from above the first base member of the bucket. In order to simplify the illustration, the rotational base has been omitted. The first base member shown by the square hatching is provided with two openings 11 and 12 so that the base member 5 only partially covers the lower end of the vessel 2.

Figure 3:
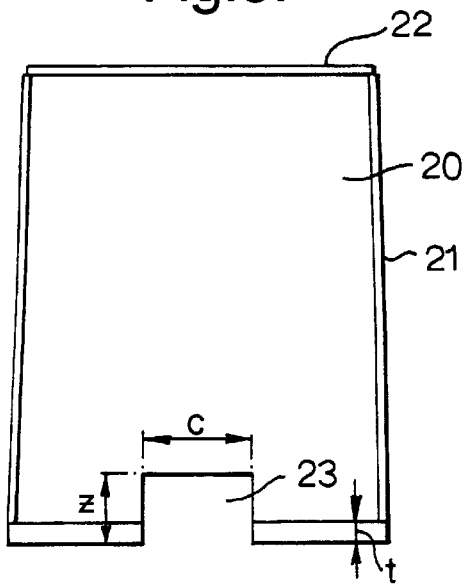
FIG. 3 shows a side elevation of a bucket embodying the present invention in which the side cutters and the rotatable base member are not shown.

The vessel 2 is defined by the vessel wall 3 which is provided with two discontinuities or "side holes" 15 and 16 at the lower end thereof (these have been more clearly illustrated in FIG. 3).

Figure 2B:
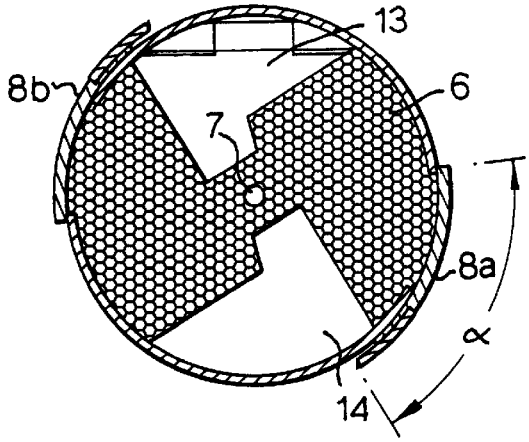
FIGS. 2B and 2C shows a cross section though the line BB shown in FIG. 1.
Figure 2C:
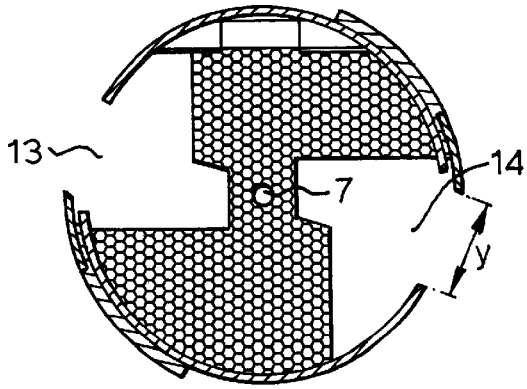

FIGS. 2B and 2C both show a cross section through the line B—B in FIG. 1 and, as such, illustrate a top plan view from just above the rotatable base member. The rotational base member 6 is rotatable about a co-axial shaft 7 and is shown by the hexagonal hatching. The rotational base member is provided with two openings 13 and 14. Two side cutters 8a and 8b are also shown and are affixed to the outer surface of the rotational base member 6 in such a way as to allow the outer wall of the vessel 3 to pass between the rotational base 6 and the cutters 8*a* and 8*b*. In the illustrated example, the side arms extend around the circumference of the vessel spanning an angle x of 66°. The position of the side cutters 8*a* and 8*b* will therefore rotate with respect to the wall of the vessel 3. In FIG. 2B, the rotatable base is shown in a so-called "closed" position in which the side cutters form an outer wall around the openings 15 and 16 in the vessel wall. In FIG. 2C however, the rotatable member 6 has been rotated with respect to the vessel walls 3 such that the two side holes in the vessel walls are aligned with the openings 13 and 14 in the base member and so as to reveal a part of the side openings 15 and 16 having a width y.

In use, the base member 5 will be positioned directly above the rotatable base member 6. As the rotatable base rotates about the co-axial shaft 7, from a position as illustrated in 2B to a position as illustrated in 2C, the openings 13 and 14 will align with the openings 11 and 12. Thus any soil which is cut by means of teeth provided on the underside of the rotatable base, and by the side cutters 8*a* and 8*b*, will be able to pass through the resultant opening into the vessel 2. In particular, soil from the side cutters 8*a* and 8*b* will also be able to enter the bucket through the side hole 15 and 16 uninhibited by the rotatable base member.

FIG. 3 shows a side elevational view of a bucket 20 embodying the present invention. In order to simplify the illustration, the side cutters and the rotatable base have not been shown. The bucket is cylindrical in shape and defined by an outer wall 21. The top of the bucket 22 will be connected to the rotary drive unit by means of a kelly bar (not shown).

Figure 4A:
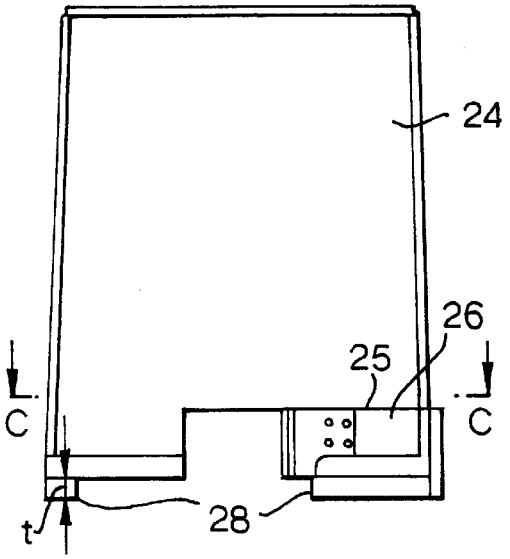
FIG. 4 shows a side elevation of a bucket embodying the present invention in which the side cutters and the rotatable base member are shown.
Figure 4B:
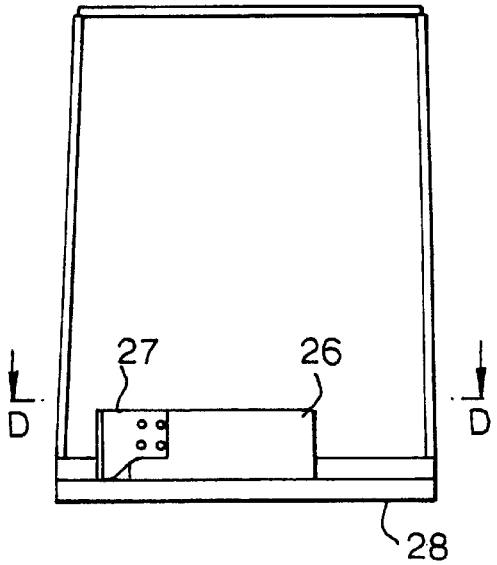

The lower end of the vessel wall 21 is provided with a side hole 23 having a circumferential width c and a length z, which allows soil generated during the drilling phase of a piling operation to pass into the vessel 20. A second side hole is also provided in the opposite side of the vessel wall (not shown). In the illustrated example c measures 317 mm and z measures 200 mm FIG. 4 shows a side elevational view of a bucket 24 embodying the present invention. In this illustration a side cutter 25 is also shown which comprises a support arm 26 and a blade 27 and which rotates with the rotatable base member 28. FIG. 4A shows the position of the rotatable base 28 and the side cutter 25 in an "open" position which will allow soil to enter the vessel 24 after it is cut by the blade 27. In FIG. 4B, the side cutter serves to cover the side hole in the vessel and will therefore inhibit the flow of soil out of the vessel as it is removed from the bore.

Figure 5A:
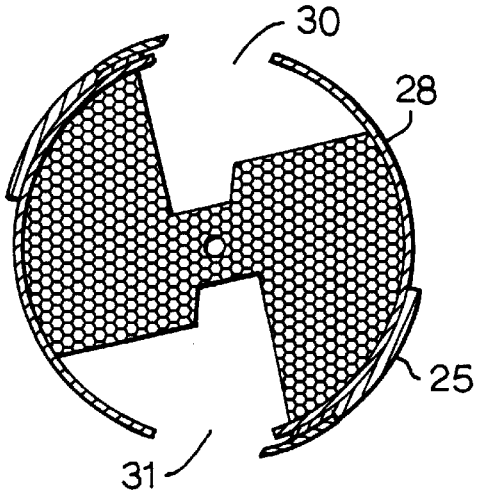
FIGS. 5A and 5B show a sectional view through the line CC and DD in FIGS. 4A and 4B respectively.
Figure 5B:
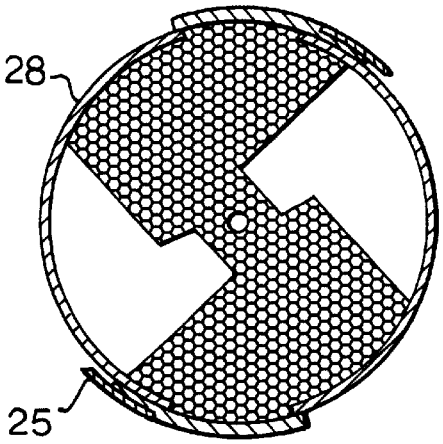

FIG. 5A shows a sectional view through the line CC shown in FIG. 4A and FIG. 5B shows a sectional view through the line DD shown in FIG. 4B, These Figures illustrate the relative positions of the rotatable base member

28, the side hole 30 and 31 provided in the vessel wall and the side cutter 25.

Figure 6:
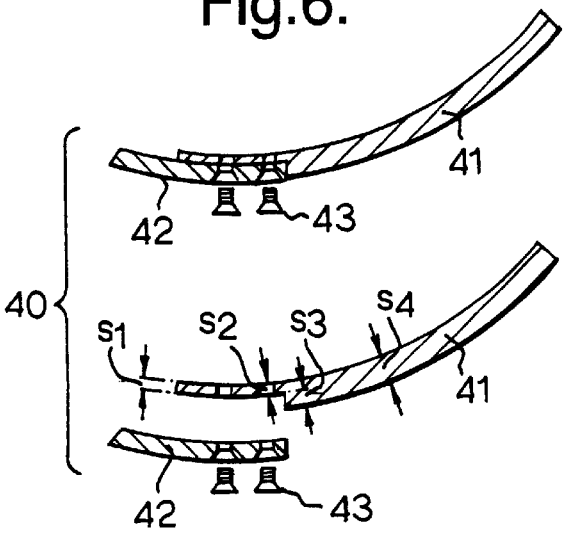
FIG. 6 shows in more detail the configuration of a cutting arm embodying the present invention.

FIG. 6 shows in more detail the configuration of a cutting arm 40 which comprises an arcuate support arm 41 which extends around part of the circumference of the cylindrical vessel, and a blade 42. The blade 42 is affixed to the support arm by means of screws 43. The dimensions of the support arm s1, s2, s3 and s4 are shown. In the illustrated example s1 is 12 mm, s2 is 16 mm, s3 is 19 mm and s4 is 35 mm.

Figure 7:
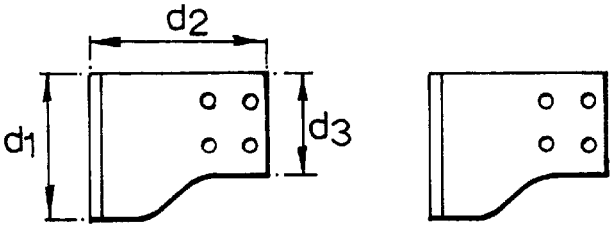
FIG. 7 shows the blade of the cutting arm embodying the present invention.
Figure 8:
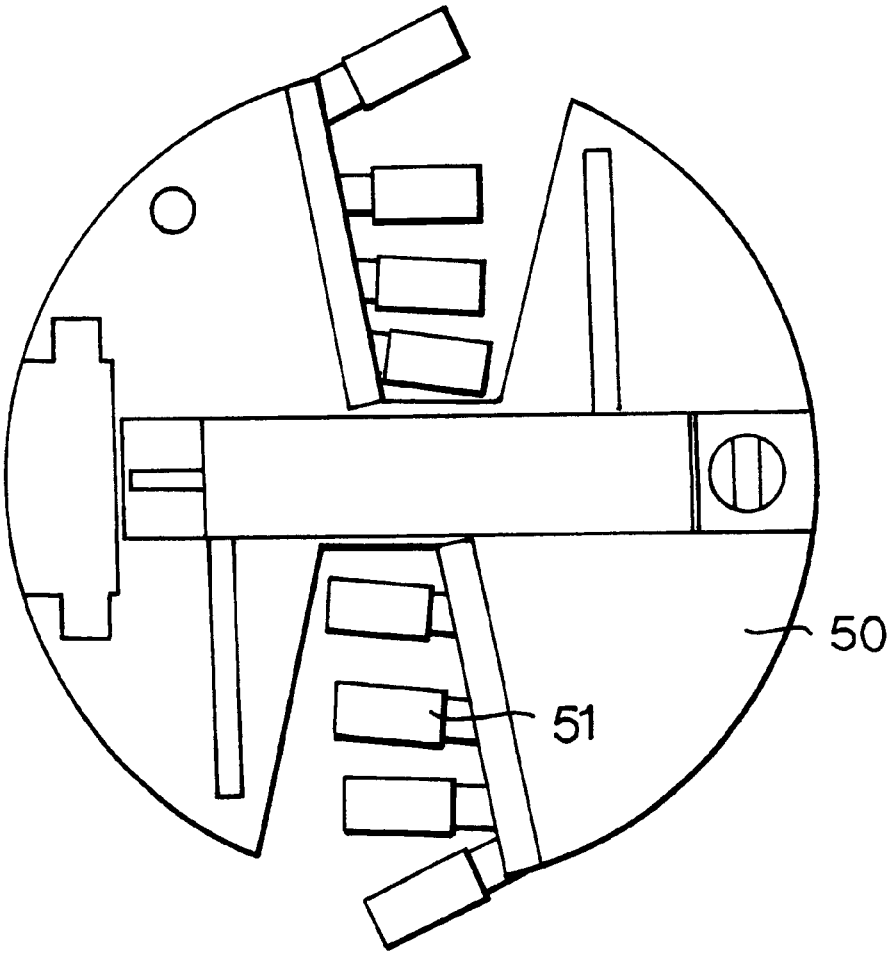
FIG. 8 shows a plan view of the underside of a rotatable base member.

FIG. 7 shows a plan view of the blade 42 and gives, by way of example only, the relative dimensions of the blade d1, d2 and d3. In this example d1 is 200 mm, d2 is 248 mm and d3 is 140 mm FIG. 8 shows a plan view of the underside of a rotatable base member 50, and shows the arrangement of cutting teeth 51 which serve to cut out soil underneath the bucket and also to cut a groove in the side wall of the bore. The side cutters (not shown) of the present invention allow the wall of the bore to be cut to a more accurate dimension.

What is claimed is:

1. A boring apparatus comprising a substantially hollow vessel having a fixed base and a rotatable base, characterised in that the rotatable base is provided, at its circumference, with at least one side cutter, the side cutter being rotatable with the rotatable base from a first position, in which the at least one side cutter serves to cover a respective opening provided in the vessel wall, to a second position, in which the opening in the vessel wall is exposed.

2. A boring apparatus as claimed in claim 1, wherein the at least one side cutter comprises a support arm and a blade.

3. A boring apparatus as claimed in claim 2, wherein the support arm is substantially arcuate in form and extends around a part of the circumference of the vessel.

4. A boring apparatus as claimed in claim 1 or 2, wherein two side cutters are provided on opposite sides of the vessel.

5. A boring apparatus as claimed in claim 1, wherein the, fixed base and the rotatable base are each provided with at least one opening therein, the openings being configured such that when the rotatable base is in said second position, the openings are at least partially aligned.

6. A boring apparatus as claimed in claim 4, wherein the fixed base and the rotatable base are each provided with at least one opening therein, the openings being configured such that when the rotatable base is in said second position, the openings are at least partially aligned.

7. A boring apparatus as claimed in claim 5, wherein the underside of the rotatable base is provided with a cutting tool.

8. A boring apparatus as claimed in claim 6, wherein the underside of the rotatable base is provided with a cutting tool.

9. A method of excavating ground material, the method comprising the steps of:

i) placing a boring apparatus into a hole in the ground or onto the ground where a hole is to be formed, the apparatus comprising a substantially hollow vessel having a fixed base and a rotatable base, wherein the rotatable base is provided, at its circumference, with at least one side cutter, the side cutter being rotatable with the rotatable base from a first position, in which the at least one side cutter serves to cover a respective opening provided in the vessel wall, to a second position, in which the opening in the vessel wall is exposed;

ii) causing the apparatus to be rotated in a first direction so that the rotatable base moves from said first position to said second position, and continuing to rotate the tool as to excavate a volume of ground material; and iii) rotating the apparatus in a direction opposite to said first direction so that the rotatable base moves from said second position to said first position.

* * * * *